US008016455B2

(12) United States Patent
Paulussen

(10) Patent No.: US 8,016,455 B2
(45) Date of Patent: Sep. 13, 2011

(54) OPTICAL DEVICE FOR CREATING AN ILLUMINATION WINDOW

(75) Inventor: Elvira Johanna Maria Paulussen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 148 days.

(21) Appl. No.: 12/096,922

(22) PCT Filed: Dec. 11, 2006

(86) PCT No.: PCT/IB2006/054742

§ 371 (c)(1),
(2), (4) Date: Jun. 11, 2008

(87) PCT Pub. No.: WO2007/069181

PCT Pub. Date: Jun. 21, 2007

(65) Prior Publication Data

US 2008/0304263 A1 Dec. 11, 2008

(30) Foreign Application Priority Data

Dec. 12, 2005 (EP) ..... 05111953

(51) Int. Cl.
*F21S 8/00* (2006.01)

(52) U.S. Cl. ..... 362/268; 362/244; 362/559; 362/560; 362/561

(58) Field of Classification Search ..... 362/268, 362/244, 559, 560, 561, 333–335; 359/618–623
See application file for complete search history.

(56) References Cited

U.S. PATENT DOCUMENTS

| | | | | |
|---|---|---|---|---|
| 5,577,493 | A | 11/1996 | Parkyn, Jr. et al. | |
| 5,896,162 | A * | 4/1999 | Taniguchi | 347/244 |
| 6,371,623 | B1 | 4/2002 | Toyoda | |
| 6,385,229 | B1 * | 5/2002 | Hiiro | 372/101 |
| 6,407,870 | B1 * | 6/2002 | Hurevich et al. | 359/668 |
| 6,552,760 | B1 * | 4/2003 | Gotoh et al. | 349/56 |
| 7,450,857 | B2 * | 11/2008 | Dress et al. | 398/164 |
| 7,537,347 | B2 * | 5/2009 | Dewald | 353/38 |
| 2004/0246606 | A1 | 12/2004 | Benitez et al. | |
| 2006/0033889 | A1 * | 2/2006 | Terashima et al. | 353/85 |

FOREIGN PATENT DOCUMENTS

| | | | |
|---|---|---|---|
| EP | 0523927 | A2 | 1/1993 |
| EP | 0905439 | A2 | 3/1999 |
| GB | 2398926 | A | 9/2004 |
| WO | 0036336 | A1 | 6/2000 |
| WO | 03066374 | A2 | 8/2003 |
| WO | 2005103562 | A2 | 11/2005 |

OTHER PUBLICATIONS

M. Henri Chretien, "Le Telescope De Newton Et Le Telescope Aplanetique" ("Newton's Telescope and the Aplanatic Telescope"), Published Feb. 1922 in Revue Doptique, Theorique Et Instrumentale.

* cited by examiner

*Primary Examiner* — Jong-Suk (James) Lee
*Assistant Examiner* — Mark Tsidulko

(57) ABSTRACT

An optical device for creating an illumination window includes radiation sources and an optical element. The optical element is arranged to create a substantially collimated radiation beam from radiation generated by the radiation sources, in which the radiation generated by the respective sources is substantially unmixed. The optical device further includes a first lens plate having first sub-lenses, in which each first sub-lens projects a part of the radiation beam at an illumination window, such that the projections of each first sub-lens at least partially overlap.

17 Claims, 7 Drawing Sheets

OPTICAL DEVICE FOR CREATING AN ILLUMINATION WINDOW

FIELD OF THE INVENTION

The invention relates to an optical device for creating an illumination window.

BACKGROUND OF THE INVENTION

Light-emitting diodes (LEDs) are well known in the prior art. A LED is formed by a semiconductor die, with a P-type semiconductor layer and an N-type semiconductor layer positioned on top of each other. A PN junction is defined between the P-type semiconductor layer and the N-type semiconductor layer. When a voltage is applied to the LED, holes in the P-type semiconductor layer and electrons in the N-type semiconductor layer are attracted and meet at the PN junction. When holes and electrons combine, photons are created, resulting in a radiation beam (light).

The LED may sit in a reflective cup that acts as a heat sink for transporting heat generated by the LED and a reflector for reflecting the created radiation beam.

LEDs typically emit a single wavelength of light, depending on the band-gap energy of the materials forming the PN junction. Nowadays, a variety of colors can be generated on the basis of the material used for making the LED. For instance, LEDs made with gallium arsenide produce infrared and red light. Other examples are gallium aluminum phosphide (GaAlP) for green light, gallium phosphide (GaP) for red, yellow and green light and zinc selenide (ZnSe) for blue light.

LEDs typically produce non-collimated radiation beams. Therefore, efforts have been made to collimate the light generated by a LED. Especially in the field of high-power LEDs, mixing of colors as well as beam-shaping and collimation optics are topics of frequent discussion. Even before the invention of LEDs, different ways of transforming a point source (in this case the LED) into a collimated radiation beam were known. An article entitled *Le télescope de Newton et le télescope aplanétique*, by M. Henri Chrétien, published in February 1922 in Revue Dóptique—Théorique et Instrumentale, describes the mathematics of transforming a point source into a collimated radiation beam using two reflective surfaces.

These mathematical techniques were used to develop optical elements to collimate a radiation beam generated by a LED. In this text, "collimated beam" is to be understood to denote radiation beams that are substantially parallel, i.e. parallel within 10° or 20°.

US 2004/0246606A1 describes such an optical element that is positioned over an optical source, such as a dome-packaged LED or an array of LEDs. The LED is positioned within a cavity of the optical element. The optical element is formed in such a way that the radiation beam generated by the LED enters the optical element via an entrance surface of the cavity. The radiation beam is reflected twice inside the optical device before it exits the optical element as a substantially collimated radiation beam. The optical element according to US 2004/0246606A1 will be explained in more detail below with reference to FIG. 1.

WO 2005/103562A2 addresses the problem of generating white light from a plurality of colored LEDs. According to this document, an optical manifold is provided for combining a plurality of LED outputs into a single, substantially homogeneous mixed output. Other known mixing techniques use mixing rods, light guides, reflectors or combinations thereof. However, these techniques are relatively large and bulky.

OBJECT AND SUMMARY OF THE INVENTION

It is an object of the invention to further improve the prior art.

An aspect of the claimed invention provides an optical device for creating an illumination window, the optical device comprising a plurality of radiation sources and an optical element, the optical element being arranged to create a substantially collimated radiation beam from radiation generated by the plurality of radiation sources, in which the radiation generated by the respective plurality of radiation sources is substantially unmixed, wherein the optical device further comprises a first lens plate having a plurality of first sub-lenses of the first lens plate, in which each first sub-lens projects a part of the radiation beam at an illumination window, such that the projections of each first sub-lens at least partially overlap.

Such an optical device provides a simple and compact tool for mixing and/or shaping a substantially collimated radiation beam which is, for instance, not colored homogeneously.

An embodiment of the claimed invention provides an optical device comprising a second lens plate having a plurality of second sub-lenses, wherein the second sub-lens of the second lens plate images a corresponding first sub-lens of the first lens plate at an illumination window, such that the images of each first sub-lens of the first lens plate projected by the second sub-lens of the second lens plate at least partially overlap. The shape of the illumination window can be controlled by choosing the shape of the first sub-lenses of the first lens plate.

An aspect of the claimed invention provides a product comprising a holder accommodating an optical device as defined hereinbefore. Such a product is relatively compact and may be used to illuminate an object having a specific shape. The shape of the illumination window may be controlled by choosing the shape of the first sub-lenses.

BRIEF DESCRIPTION OF THE DRAWINGS

The present invention will now be described in more detail with reference to some embodiments and the drawings, which are only intended to illustrate the invention and not to limit its scope which is only limited by the appended claims.

DESCRIPTION OF EMBODIMENTS

US 2004/0246606 A1 describes a number of optical elements arranged to transform a non-collimated radiation beam generated by, for instance, a LED into a substantially collimated radiation beam.

Figure 1:
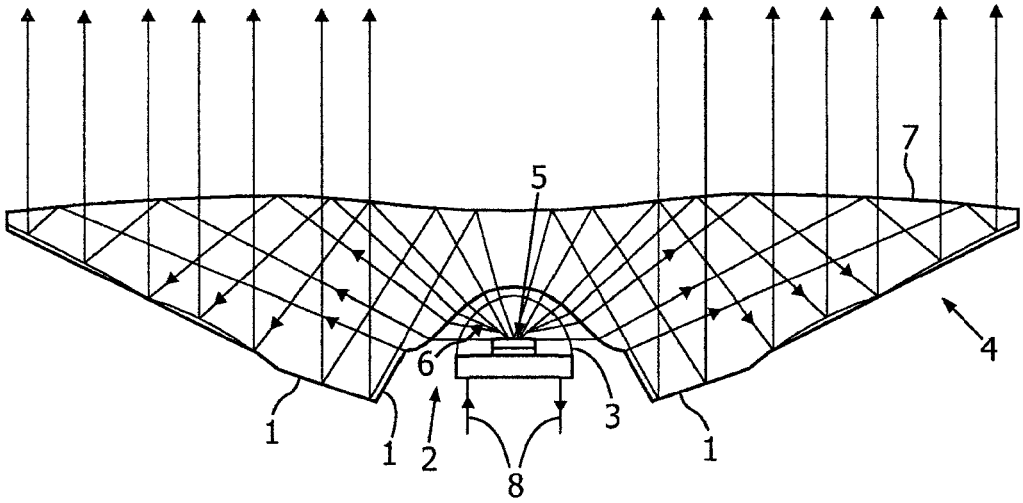
FIG. 1 schematically depicts an optical element according to the prior art.

An example of such an optical element 4 is schematically shown in FIG. 1. FIG. 1 is a cross-sectional side view of such an optical element 4, which is rotationally symmetric. The optical element 4 is formed by an entrance surface 1 and an exit surface 7. In fact, the LED 3 is positioned in a cavity 2 formed in the entrance surface 1. The LED 3 comprises a P-layer and an N-layer, denoted by reference numeral 5, as described above, and is positioned in a dome-shaped cover 6. FIG. 1 also shows electric cables 8, which are connected to the LED 3 for its electric energy supply.

Radiation generated by the LED 3 enters the optical element 4 via entrance surface 1. Subsequently, the radiation beam is reflected by the exit surface 7 by means of TIR (Total Internal Reflection) and the entrance surface 1 before it exits the optical element 4 via the exit surface 7. Exit surface 7 may be partly a mirror, for instance, in the center near LED 3. Entrance surface 1 is a mirror. The shape of the entrance surface 1 and the exit surface 7 is chosen to be such that the radiation beam exits the optical element 4 in a substantially collimated form.

Figure 2:
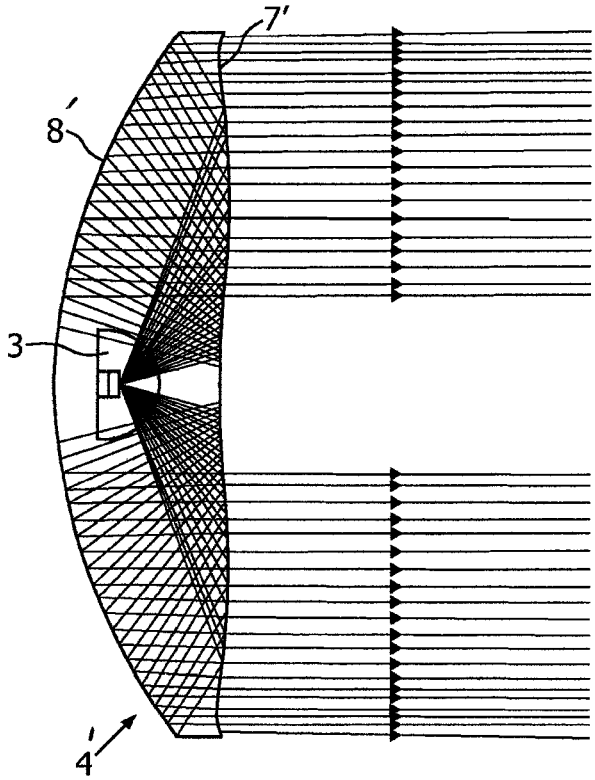
FIG. 2 schematically depicts an alternative optical element according to the prior art.

FIG. 2 schematically depicts an alternative embodiment, showing an alternative optical element 4' according to the prior art. The LED 3 is positioned completely inside this alternative optical element 4'. Again, the radiation generated by the LED 3 is reflected twice inside the optical element 4', first by exit surface 7', and subsequently by a rear surface 8', before the radiation exits the optical element 4' via exit surface 7'. The optical element 4' is also rotationally symmetric.

Different embodiments of the invention will be described below. It will be evident to a skilled person that the optical elements 4, 4' described with reference to FIGS. 1 and 2 may be used in combination with the invention. Any other optical element producing a substantially collimated radiation beam may also be used.

Different embodiments using optical element 4 or alternatives for combining a plurality of LEDs into one substantially mixed, substantially homogenous radiation beam will be described hereinafter. Even if the shape of the exit surface of optical elements 4, 4' according to the prior art, as described with reference to FIGS. 1 and 2 is adjusted, both mixing and beam-shaping are not possible.

Figure 3A:
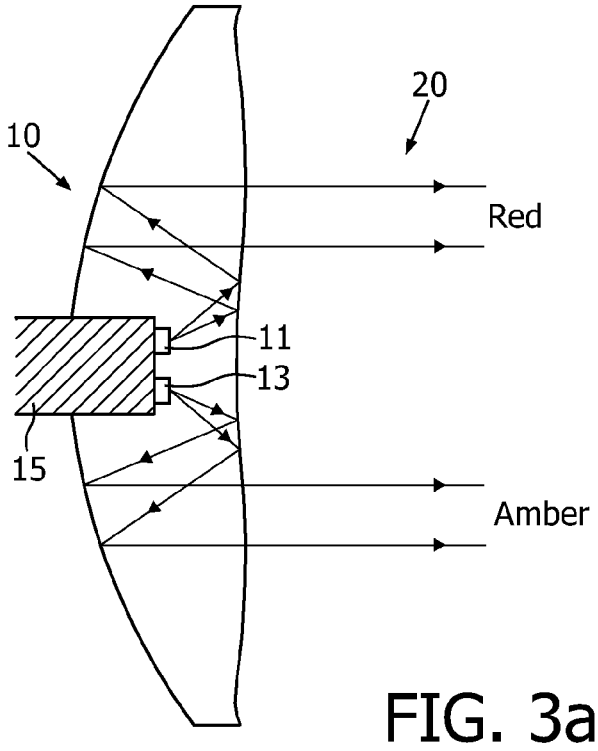
FIGS. 3*a* and 3*b* schematically depict an embodiment of an optical element.
Figure 3B:
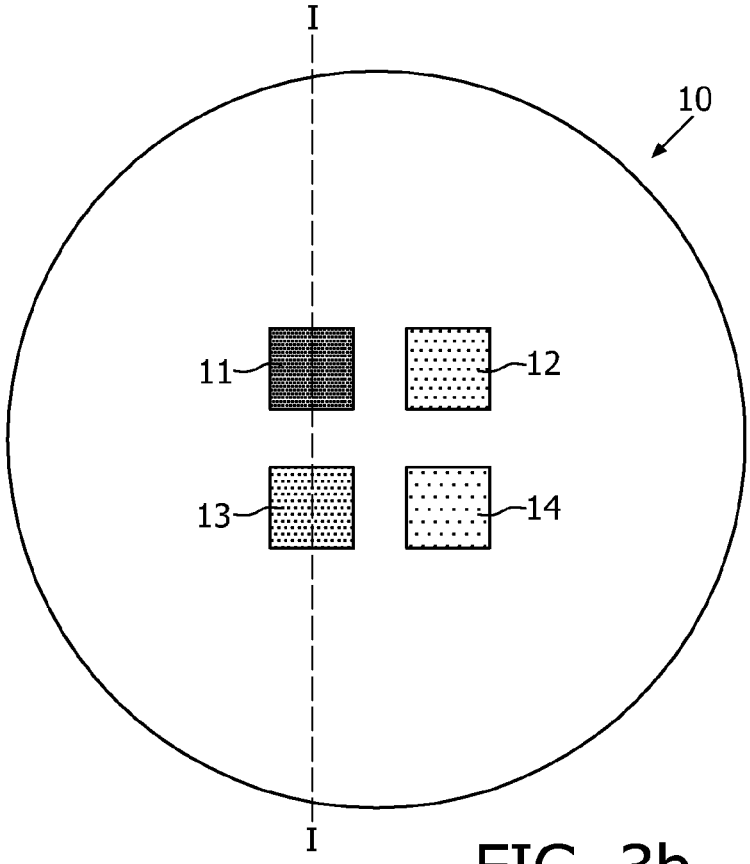

In one embodiment, an optical element 10 is provided, such as the optical elements 4, 4' described above with reference to FIGS. 1 and 2, having a plurality of positioned LEDs 11, 12, 13, 14, in which each LED 11, 12, 13, 14 may consist of a single LED or a group of LEDs, e.g. LED 11 is a group of 10 LEDs (11', 11", 11''', . . . ). FIG. 3*a* is a schematic cross-sectional side view of such an optical element 10, while FIG. 3*b* is a schematic front view of the optical element 10. The cross-sectional side view in FIG. 3*a* is taken on the broken line I-I shown in FIG. 3*b*.

A plurality of LEDs 11, 12, 13, 14 is positioned inside the optical element 10. In the example shown in FIGS. 3*a* and 3*b*, four LEDs are positioned inside the optical element 10, but any other number of LEDs may of course also be positioned in the optical element 10. Also other types of radiation sources may be used.

In the example shown in FIGS. 3*a* and 3*b*, the LEDs 11, 12, 13, 14 are positioned in the optical element 10 on a carrier 15. This carrier 15 may be made of a conductive material, but also of any other type of suitable material. For instance, the carrier 15 may be made of a material that is specially suited for dissipating heat produced by the LEDs 11, 12, 13, 14.

The LEDs 11, 12, 13, 14 may emit radiation of different colors. In the embodiment shown in FIGS. 3*a* and 3*b*, the first LED 11 may emit red radiation, the second LED 12 may emit green radiation, the third LED 13 may emit amber radiation and the fourth LED 14 may emit blue radiation. In an alternative embodiment, three LEDs may be used, the first LED 11 emitting red radiation, the second LED 12 emitting green radiation and the third LED emitting blue radiation. Of course, any suitable number of LEDs having any combination of colors may be used, as will be evident to a skilled person. The LEDs 11, 12, 13, 14 may have one and the same color.

As can be seen in FIG. 3*a*, the optical element 10 produces a substantially collimated radiation beam. As already stated above, the term "collimated" is used herein to denote a radiation beam that is substantially parallel. For reasons of simplicity, the radiation beam 20 is depicted in the Figure as a 'perfect' collimated radiation beam.

Figure 4:
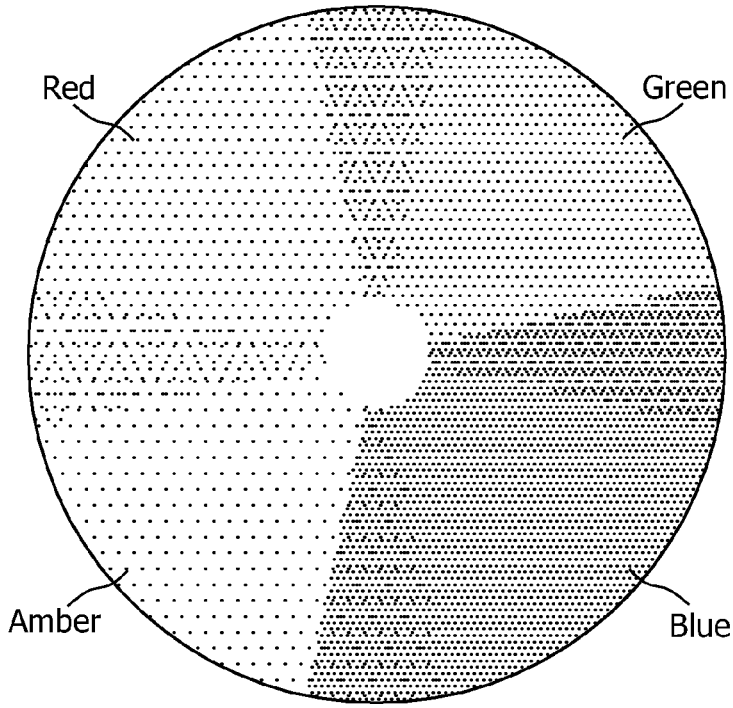
FIG. 4 is a schematic cross-sectional view of a radiation beam in accordance with an embodiment.

It will be understood that radiation beam 20 does not have a homogeneous color, but will be predominantly red at the top and predominantly amber at the lower side along line I-I, in accordance with the orientation shown in FIGS. 3*a* and 3*b*. In fact, the radiation beam 20 has four colors, as shown in FIG. 4, which is a cross-sectional view of the radiation beam 20 as emitted by the optical element 10.

However, it will be evident to a skilled person that the radiation beam 20 as emitted by the optical element 10 is already mixed to a certain extent if the radiation source, i.e. the composition of the four LEDs 11, 12, 13, 14, is relatively small with respect to the optical element 10.

Figure 5:
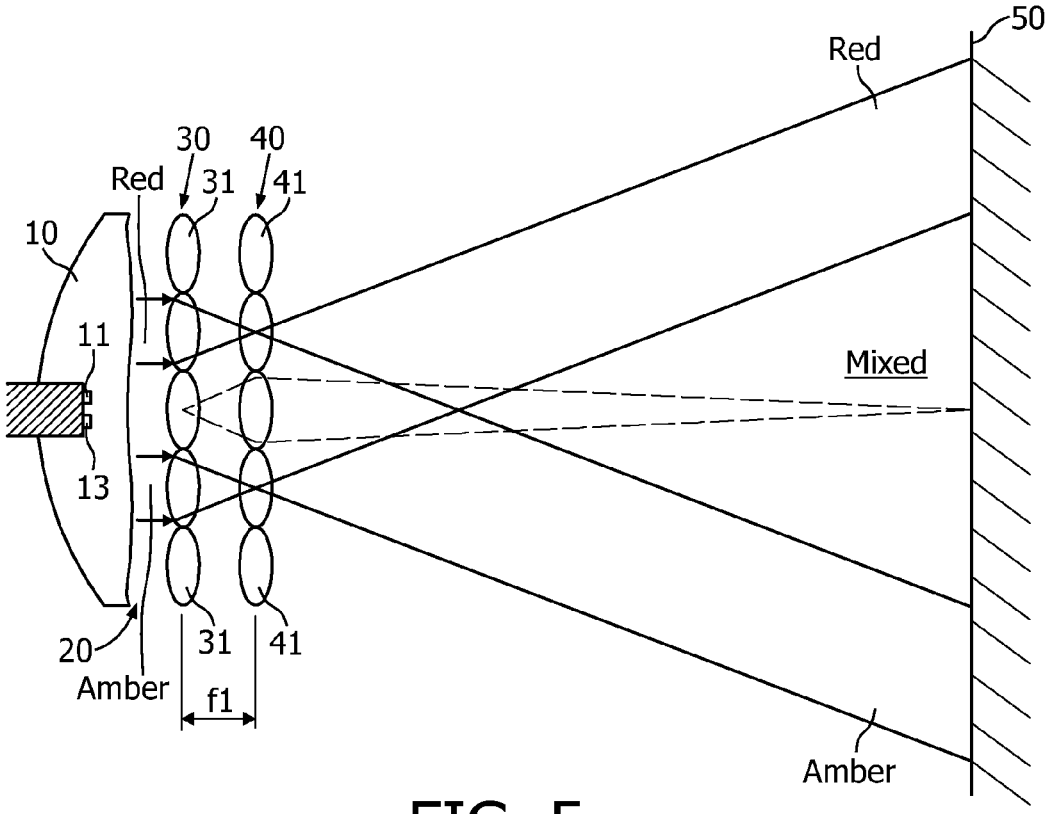
FIG. 5 schematically depicts an embodiment of a set-up.

In one embodiment, a device is provided for mixing the radiation emitted by the different LEDs 11, 12, 13, 14. In order to achieve this, a first lens plate 30 and a second lens plate 40 are provided in accordance with an embodiment, as is schematically depicted in FIG. 5. The first lens plate 30 comprises a plurality of sub-lenses 31 and the second lens plate 40 comprises a plurality of sub-lenses 41. The sub-lenses 31, 41 of the lens plates 30, 40 are also referred to as lenslets.

Figure 6A:
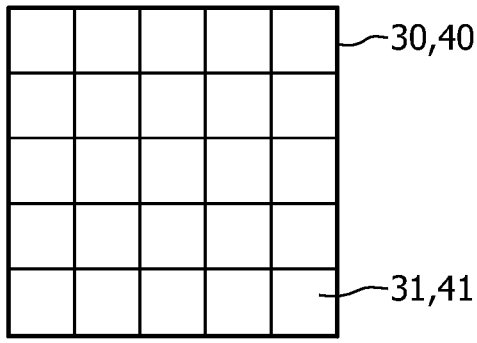
FIGS. 6*a*, 6*b* and 6*c* schematically depict different embodiments of lens plates.

FIG. 6*a* is a schematic front view of a first lens plate 30 and/or a second lens plate 40, which may be similar. It can be seen that the first and second lens plates 30, 40 may have a square shape (or a rectangular shape) and comprise 5×5 square-shaped sub-lenses 31, 41. It will be understood that many alternative shapes and numbers of sub-lenses 31, 41 are possible for the first lens plate 30 and the second lens plate 40, as well as for the sub-lenses 31, 41.

Figure 6B:
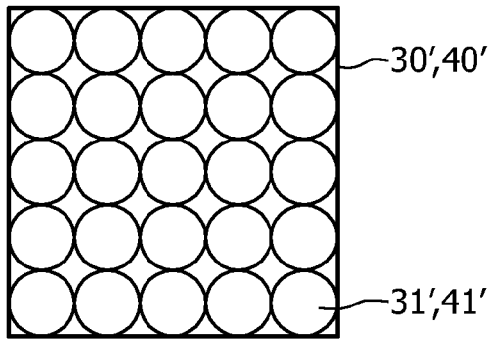

FIG. 6*b* is a schematic front view of an alternative first lens plate 30' and a second lens plate 40'. It can be seen that the first and second lens plates 30', 40' may be substantially square-shaped in this embodiment and comprise 5×5 circular sub-lenses 31', 41'.

Figure 6C:
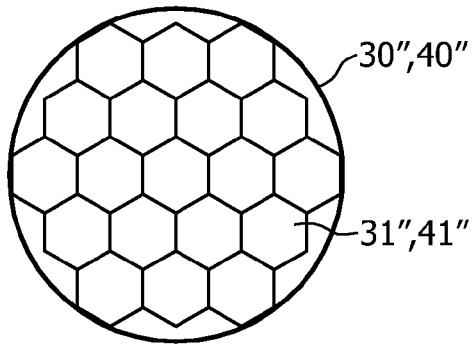

FIG. 6*c* is a schematic front view of a further alternative first lens plate 30" and a second lens plate 40". It can be seen that the first and second lens plates 30", 40" are substantially circular in this case and comprise a plurality of hexagonal sub-lenses 31", 41" (honeycomb).

It will be understood that many alternative lens plates 30, 40 are conceivable. Different numbers of sub-lenses 31, 41 may also be used. In fact, lens plate 30, lens plate 40, the first sub-lenses 31 of the first lens plate 30 and the second sub-lenses 41 of the second lens plate 40 may be similar, but may also be different from each other and have, for instance, a different size and/or shape.

Based on FIG. 5, it can be seen that a lens plate 30 is positioned behind the optical element 10, comprising a number of sub-lenses 31. Each sub-lens 31 has substantially the same focal distance f1. The second lens plate 40 is positioned substantially at a distance f1 from the first lens plate 30.

It can be seen in FIG. 5 that the second lens plate 40 images the lenslets 31 of the first lens plate 30 onto an illumination window 50. This aspect is indicated by the broken lines in FIG. 5. Note that the illumination window 50 is relatively far remote from the second lens plate 40 and, for practical purposes, may thus be considered to be the far field. The first lens plate may be in the focal plane of the second lens plate, but may also be near the focal plane of the second lens plate 50.

The optical device may comprise a second lens plate 40 having a plurality of second sub-lenses 41, wherein the second sub-lenses 41 of the second lens plate 40 image a corresponding first sub-lens 31 of the first lens plate 30 at the illumination window 50, such that the images of each first sub-lens 31 of the first lens plate 30 projected by the second sub-lens 41 of the second lens plate 40 at least partially overlap.

This illumination window 50 may be in the far field and may coincide with an object that is to be illuminated. In practice, such an object may have a surface that is to be illuminated by the LEDs 11, 12, 13, 14, such as, for instance, a painting, a table, a window, a building, etc. The techniques described here may also be used in projection display applications. It is to be noted that illumination window 50 is relatively far remote from the second lens plate 40, which is only schematically depicted in the Figures.

The term "far field" is used herein to denote that the illumination window is relatively far remote from the second lens plate 40. In practice, the lens plate 40 may have a diameter of only a few centimeters, in which case the term far field could refer to a distance of approximately 2 m.

Two sub-parts of the radiation beam 20 are depicted in FIG. 5: a red sub-part and an amber sub-part. The red sub-part is projected in the far field via a sub-lens 31 of the first lens plate 30 and a corresponding sub-lens 41 of the second lens plate 40. The amber sub-part is projected in the far field via a further sub-lens 31 of the first lens plate 30 and a further corresponding sub-lens 41 of the second lens plate 40.

FIG. 5 shows that the red sub-part and the amber sub-part are mixed to a large extent in the illumination window 50. In fact, the radiation emitted by all of the LEDs 11, 12, 13, 14 is substantially mixed in the illumination window 50. If the LEDs 11, 12, 13, 14 emit different colors, these colors are mixed in the illumination window, creating, for instance, white light.

Figure 7A:
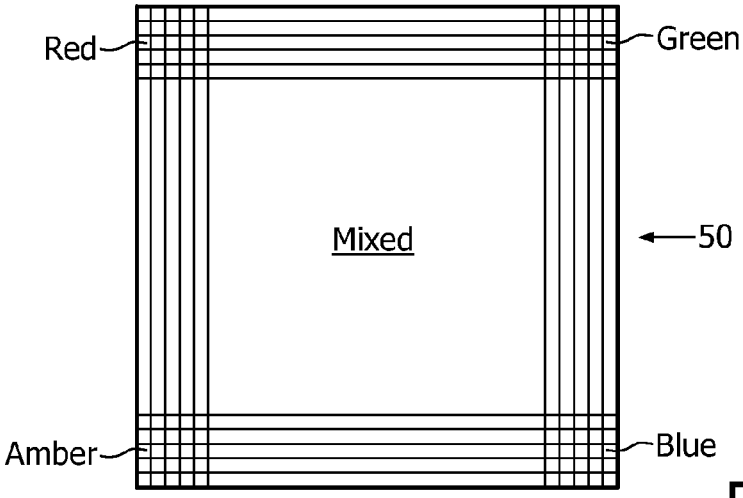
FIGS. 7*a*, 7*b* and 7*c* schematically depict different embodiments of illumination windows.

FIG. 7*a* schematically depicts the illumination window 50 of the radiation beam 20 as projected by the first lens plate 30 and the second lens plate 40 in the far field. The projection comprises 25 square-shaped sub-projections. Each sub-projection is generated by a corresponding pair of a sub-lens 31 of the first lens plate 30 and a sub-lens 41 of the second lens plate 40. The sub-projections are shifted with respect to each other. However, this shift may be relatively small in comparison with the size of the illumination window 50 and therefore negligible in practical use. The shift is equal to the distance of respective sub-lenses 31. The shape of each sub-projection is determined by the shape of the first sub-lens 31 of the first lens plate 30. Each sub-lens 41 of the second lens plate 40 images the contour of each sub-lens 31 of the first lens plate 30 in the far field. As a result, the radiation beams as generated by the different LEDs 11, 12, 13, 14 are substantially mixed in the illumination window.

It will be understood that the number of sub-lenses 41 of the second lens plate 40 may be equal to the number of sub-lenses 31 of the first lens plate 30, as each sub-lens 41 of the second lens plate 40 images the contour of a corresponding sub-lens 31 of the first lens plate 30. In order to do this, the focal distance f2 of the sub-lenses 41 of the second lens plate 40 may be substantially equal to the focal distance f1 of the sub-lenses 31 of the first lens plate 30. The first sub-lenses 31 of the first lens plate 30 may also be positioned at a distance from the corresponding sub-lenses 41 of the second lens plate, which distance is equal to the focal distance of the second sub-lenses 41 of the second lens plate 40.

It will also be understood that the illumination window is in the far field, although the Figures show it relatively close to the second lens plate 40.

It will further be understood that the focal distances of the sub-lenses 31, 41 and the mutual distance between the first lens plate 30 and the second lens plate 40 do not necessarily need to be exactly equal to each other. Variations are allowed, for instance, variations that are equal to the thickness of the lens plates 30, 40. The focal distances of the sub-lenses 31, 41 and the distance between the first lens plate 30 and the second lens plate 40 may be adjusted on the basis of the characteristics of the radiation beam 20 or on the basis of the desired size of the illumination window 50 at a certain distance.

Figure 7B:
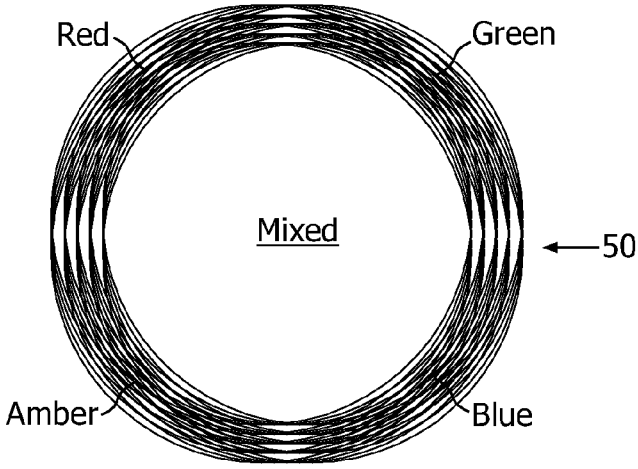
Figure 7C:
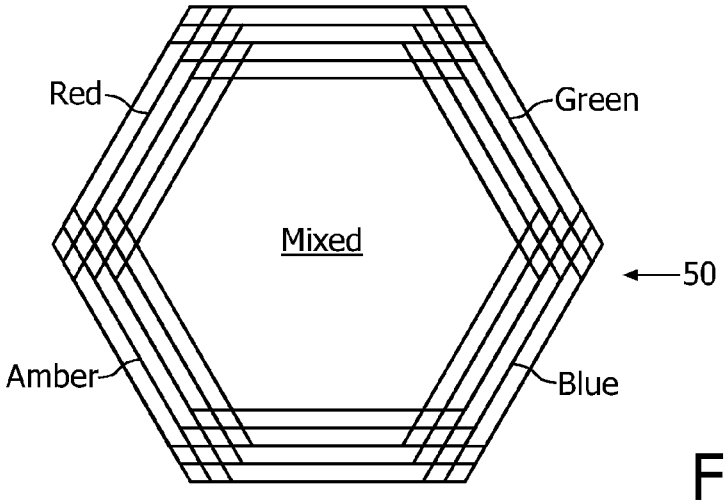

Based on the above, it will be understood that the shape of each sub-projection, and thus the illumination window 50, is determined by the shape of the sub-lens 31 of the first lens plate 30. If a lens plate 30' is chosen as shown in FIG. 6*b*, each sub-projection will thus be substantially circular, as schematically shown in FIG. 7*b*. The total illumination window will also roughly be circular. If a lens plate 30" is used as shown in FIG. 6*c*, each sub-projection is substantially hexagonal, as schematically shown in FIG. 7*c*. The total illumination window will also roughly be hexagonal. However, it will be understood that, in practice, the mixed parts as shown in FIGS. 7*a*, 7*b* and 7*c* are relatively large in comparison with the edge that is not completely mixed and may be negligibly small in practice.

The shape of the sub-projections in the far field 50 may thus be determined by the shape of the sub-lenses 31 of the first lens plate 30. As a result, an advantageous and simple beam-shaping device is presented here. The shape of the sub-lenses 31 of the first lens plate 30 may be chosen to be dependent on the shape of the object that is to be illuminated. If an object having e.g. a rectangular shape is to be illuminated, the sub-lenses 31 of the first lens plate 30 may be given a corresponding rectangular shape. If a circular table is to be illuminated, circular sub-lenses 31' of the first lens plate 30' may be chosen, as shown in FIGS. 6*b* and 7*b*.

The device presented here also provides an advantageous way of mixing a substantially collimated beam.

The size of each sub-projection in the far field 50 may be changed by changing the distance between the first lens plate 30 and the second lens plate 40. It will be understood that also the focal distance f1 and the focal distance f2 may be changed accordingly.

Figure 8:
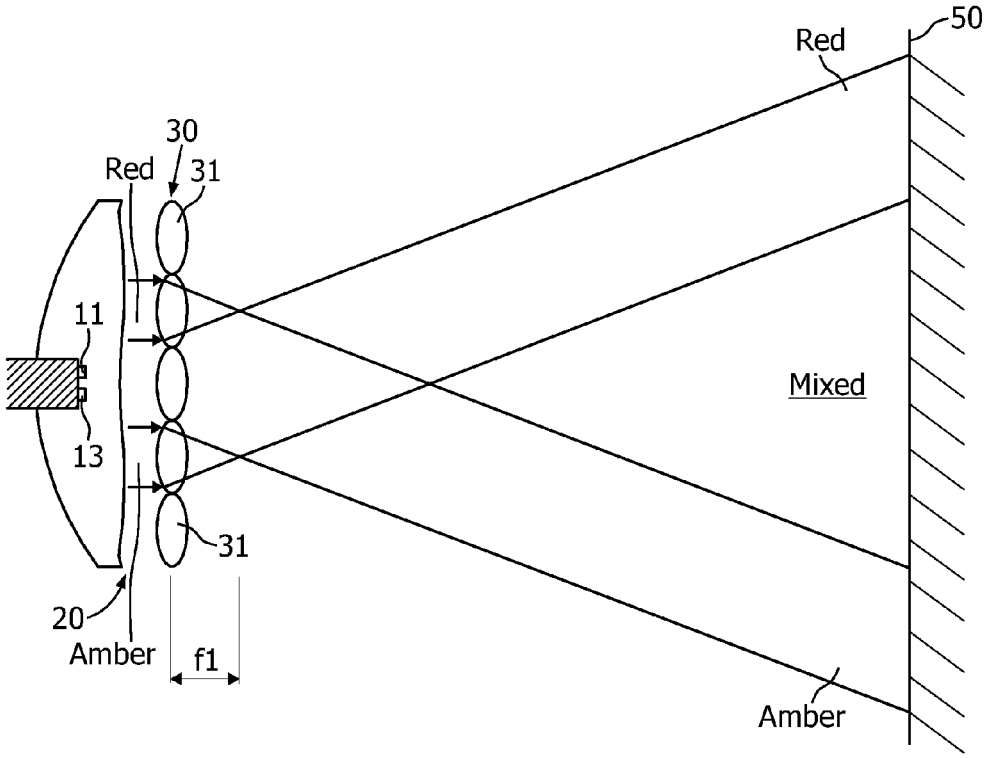
FIG. 8 schematically depicts an alternative embodiment of a set-up.

In one embodiment, the second lens plate 40 is omitted, as is shown in FIG. 8. As will be evident to a skilled person, the second lens plate 40 no longer has an imaging function (broken lines in FIG. 5). Mixing of the radiation from different radiation sources (LEDs 11, 12, 13, 14) and beam-shaping in accordance with the set-up of FIG. 5 therefore has a higher quality as compared with mixing of the set-up as shown in FIG. 8.

Figure 9A:
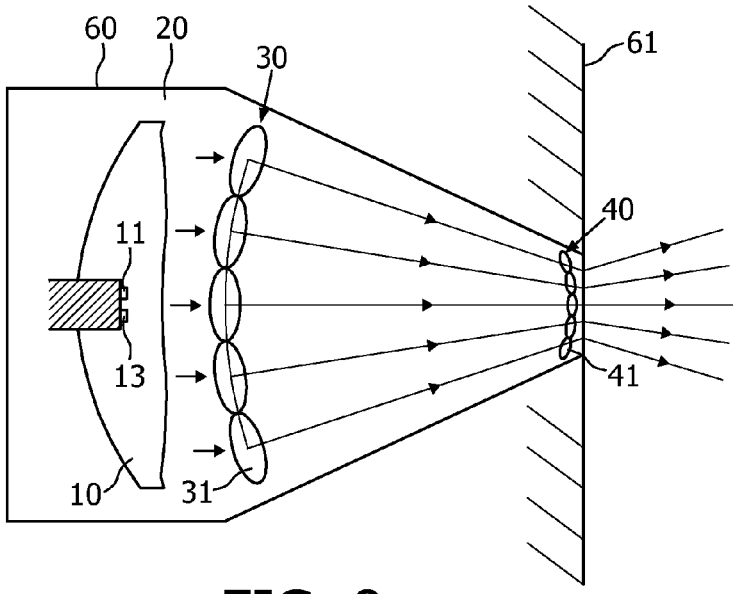
FIGS. 9*a*, 9*b* and 10*a*, 10*b* schematically depict different embodiments of different set-ups.

In another embodiment, the first lens plate 30 may have a size which is different from that of the second lens plate 40, as is schematically shown in FIG. 9*a*. In FIG. 9*a*, the second lens plate 40 is relatively small in comparison with the first lens plate 30. The optical element 10, the first lens plate 30 and the second lens plate 40 are accommodated in a holder 60, providing a small and compact product. Since the second lens plate 40 is relatively small, the product may easily be mounted in a wall 61 (or a ceiling), requiring only a relatively small opening in the wall 61.

The sub-lenses 31 of the first lens plate 30 are positioned in a semi-circular configuration or the like. Each sub-lens 31 of the first lens plate 30 may have a different orientation. Accordingly, the sub-lenses 41 of the second lens plate 40 are positioned in a semi-circular configuration, but in an opposite direction, as can be seen in FIG. 9*a*. Each sub-lens 41 of the second lens plate 40 may have a different orientation. Consequently, the first lens plate 30 may have a convex (rounded) shape as viewed in the direction of propagation of the radiation beam 20, whereas the second lens plate 40 may have a concave (hollow) shape as viewed in the direction of propagation of the radiation beam 20.

It will be evident to a skilled person that a first sub-lens 31 of the first lens plate 30 and a second sub-lens 41 of the second lens plate 40 may have a similar tilt with respect to their orientation as shown in FIG. 5, but in opposite directions. The orientation of each second sub-lens 41 of the second lens plate 40 may be chosen to be dependent on the orientation of the first sub-lens 31 of the first lens plate 30, or vice versa.

In accordance with a further embodiment, all sub-lenses 31 of the first lens plate 30 are positioned in a straight line with tilted orientations, and the sub-lenses 41 of the second lens plate 40 are also positioned in a straight line with tilted orientations. Each first sub-lens 31 of the first lens plate 30 may have an opposite tilt with respect to the tilt of the second sub-lens 41 of the second lens plate 40. This is shown in FIG. 9*b*.

Figure 9B:
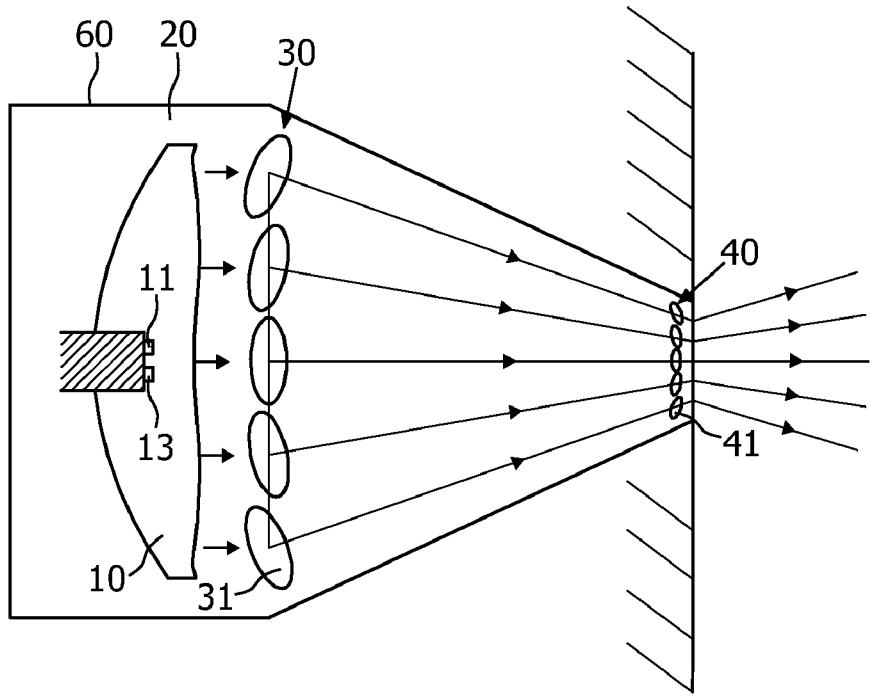

The focal distances of the first and second sub-lenses 31, 41 of the first and second lens plates 30, 40 may vary in the embodiments shown in FIGS. 9*a* and 9*b*, as the distances between the corresponding sub-lenses 31, 41 from the first and second lens plates 30, 40 also vary.

Figure 10A:
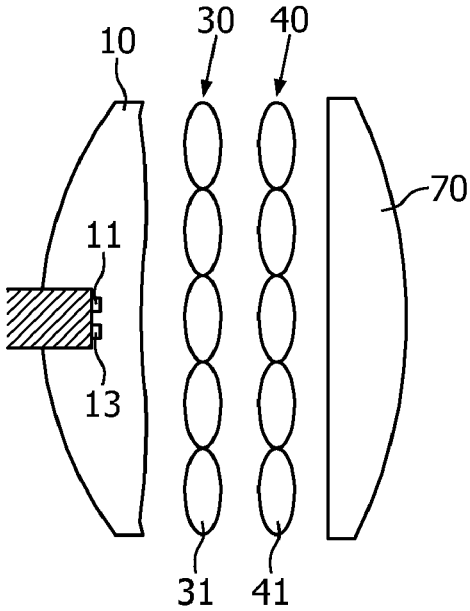
Figure 10B:
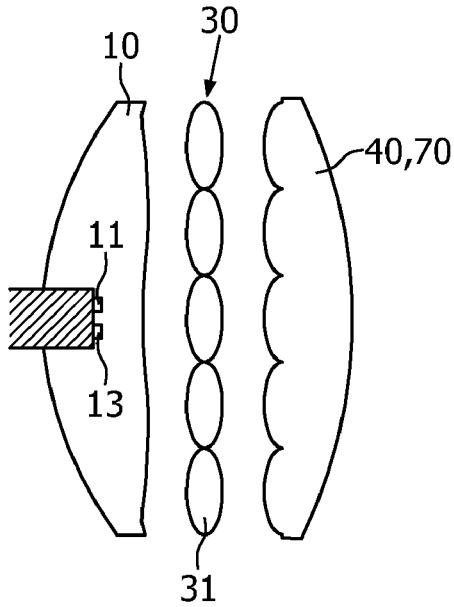

In a further embodiment, a spherical or aspherical optical element, such as an (aspherical) lens 70 is positioned behind the second lens plate 40, as is shown in FIG. 10*a*. In accordance with a variant, the (aspherical) lens 70 is integrated in the second lens plate 40, as is shown in FIG. 10*b*.

In another embodiment, the optical device comprises a spherical or an aspherical optical element, such as a lens 70 positioned behind the second lens plate 40 as viewed in the direction of propagation of radiation emitted, in use, by the radiation sources 11, 12, 13, 14, for instance, integrated in the second lens plate 40.

The use of such an (aspherical) lens 70 enhances the beam performance.

Based on the above, a plurality of LEDs is positioned in an optical element 10. The radiation beam 20 generated by the optical element 10 is substantially collimated, but the radiation from the different LEDs 11, 12, 13, 14 is still unmixed in the far field. A lens plate 30 and possibly a second lens plate 40 are provided to mix the radiation of the different LEDs 11, 12, 13, 14. This mixed radiation may be used for illuminating an object, such as a wall.

The sub-lenses 31 of the first lens plate 30 may have different shapes for shaping the illumination window 50 created by the optical device. Of course, also a diaphragm may be positioned after each sub-lens 31 of the first plate 30 so as to shape the radiation beam.

All of the LEDs 11, 12, 13, 14 may have a different color. The color of the mixed illumination beam may be changed by controlling the current of each LED 11, 12, 13, 14. However, the LEDs 11, 12, 13, 14 may also have one and the same color.

All of the LEDs 11, 12, 13, 14, the optical element 10, the first lens plate 30 and the second lens plate 40 may be integrated in a single holder 60 or cover. Such a product is relatively small and compact. The product may be, for instance, approximately 15 cm large, but may also be smaller than 10 cm, producing an illumination window of approximately 25×25 cm at a distance of approximately 2 m from the second lens plate 40.

The embodiments described above provide a simple and compact optical device for mixing different parallel, substantially collimated radiation beams. At the same time, a simple and compact beam-shaping tool is provided. The optical device shown above may be relatively small, with a length (from optical element 10 to second lens plate 40) that may be well below 10 cm, while it provides a relatively large illumination window at a relatively short distance, in combination with a good color-mixing and beam-shaping.

Furthermore, the (high-power) LEDs 11, 12, 13, 14 may easily be cooled at the rear side of the optical element 10, via carrier 15.

An optical device creating an illumination window by mixing a plurality of LEDs 11, 12, 13, 14 has been described. However, it will be evident that also other radiation sources (light sources), such as (light) bulbs, (corona) discharge lamps, etc. may be used instead of LEDs 11, 12, 13, 14.

It will also be evident that other set-ups may be used instead of a plurality of radiation sources positioned inside an optical element 10. In fact, the first lens plate 30 and the second lens plate 40 may be used to create an illumination window from any substantially collimated, possibly unmixed, radiation beam 20.

Preferred embodiments of the method and devices according to the invention have been described for the purpose of teaching the invention. It will be evident to those skilled in the art that other alternative and equivalent embodiments of the invention can be conceived and realized in practice without departing from the true spirit of the invention, the scope of the invention being only limited by the appending claims.

The invention claimed is:

1. An optical device for creating an illumination window, the optical device comprising:

a plurality of radiation sources;

an optical element, the optical element being arranged to create a substantially collimated radiation beam from radiation generated by the plurality of radiation sources, wherein a radiation generated by the respective plurality of radiation sources is substantially unmixed; and a first lens plate having a plurality of first sub-lenses, wherein each first sub-lens projects a part of the collimated radiation beam at the illumination window, such that projections of the each first sub-lens at least partially overlap; and a second lens plate having a plurality of second sub-lenses, wherein the plurality of the first sub-lens projects a part of the collimated radiation beam to the plurality of second sub-lenses for projecting of the part of the collimated radiation beam at the illumination window, and wherein a first lens of the first sub-lenses is tilted by a tilt angle in a first direction, and a second lens of the second sub-lenses is tilted by the tilt angle in a second direction, wherein the first direction is opposite the second direction so that the first lens and the second lens have a same tilt but in opposite directions.

2. The optical device according to claim 1, wherein the plurality of radiation sources is formed by light-emitting diodes.

3. The optical device according to claim 1, wherein the plurality of radiation sources each emits a different radiation wavelength.

4. The optical device according to claim 1, wherein the second sub-lens of the second lens plate images a corresponding first sub-lens of the first lens plate at the illumination window, such that the images of each first sub-lens of the first lens plate projected by the second sub-lens of the second lens plate at least partially overlap.

5. The optical device according to claim 4, wherein each first sub-lens of the first lens plate has a focal distance, and the second sub-lenses of the second lens plate are positioned at the focal distance of each corresponding first sub-lens of the first lens plate.

6. The optical device according to claim 4, wherein the first sub-lens of the first lens plate and the corresponding second sub-lens of the second lens plate differ in size.

7. The optical device according to claim 4, wherein different first sub-lenses of the first lens plate of the plurality of first sub-lenses of the first lens plate have different orientations, and wherein different second sub-lenses of the second lens plate of the plurality of second sub-lenses of the second lens plate have different orientations, the orientation of the first sub-lenses of the first lens plate being chosen to be dependent on the orientation of the second sub-lenses of the second lens plate, or vice versa.

8. The optical device of claim 4, wherein the first sub-lenses are positioned in a first semi-circular curvature having a radius of configuration, and the second sub-lenses are positioned in a second semi-circular configuration having the radius of curvature, and wherein the first semi-circular curvature is opposite the second semi-circular curvature.

9. The optical device of claim 8, wherein the first sub-lenses are larger than the second sub-lenses.

10. The optical device of claim 4, wherein the first sub-lenses have a first focal distance and the second sub-lenses have a second focal distance, the first focal distance being substantially equal to the second focal distance.

11. The optical device of claim 10, wherein the second sub-lenses are positioned a distance from the first sub-lenses, the distance being substantially equal to the first focal distance.

12. The optical device according to claim 1, wherein the plurality of first sub-lenses of the first lens plate has one of the following shapes: square-shaped, rectangular, circular, hexagonal, generating the illumination window having a corresponding shape.

13. The optical device according to claim 1, further comprising a spherical or an aspherical optical element including a lens integrated in the second lens plate and positioned behind the second lens plate as viewed in the direction of propagation of radiation emitted, in use, by the radiation sources.

14. A product comprising a holder accommodating the optical device according to claim 1.

15. The optical device of claim 1, wherein the radiation at the edges has the at least two colors separated from each other at different portions of the edges.

16. The optical device of claim 1, wherein the first lens is larger than the second lens.

17. The optical device of claim 1, wherein the radiation from at least one of the first lens plate and the second lens plate is mixed at a central portion of the illumination window and is not completely mixed at edges of the illumination window.

* * * * *